US005124896A

United States Patent [19]

Bentley

[11] Patent Number: 5,124,896

[45] Date of Patent: Jun. 23, 1992

[54] FLUORESCENT LAMP FIXTURE

[76] Inventor: Raymond B. Bentley, P.O. Box 450, Ledgewood, N.J. 07852

[21] Appl. No.: 754,642

[22] Filed: Sep. 4, 1991

[51] Int. Cl.[5] ..... F21S 3/00

[52] U.S. Cl. ..... 362/223; 362/217

[58] Field of Search ..... 362/217, 222, 221, 223

[56] References Cited

U.S. PATENT DOCUMENTS 2,559,639 7/1991 Kruger ..... 362/217

FOREIGN PATENT DOCUMENTS 3036115 4/1982 Fed. Rep. of Germany .

*Primary Examiner*—Carroll B. Dority

*Attorney, Agent, or Firm*—Joseph J. Baker

[57] ABSTRACT

A fluorescent-type lamp fixture is disclosed which can be rapidly assembled and has channel and cover members each with means to enable the members to be snapped together. The cover member carries spaced-apart holders for receiving the lamp and other electrical components. A pair of caps are provided which are plugged into the open ends of the assembled channel and cover members, the caps are shaped to insure proper alignment and effect their retention. A lens is also provided having projections that are snapped into recesses in the end caps to hold it securely. In another embodiment, a light shield is rotatably mounted on adaptors positioned adjacent to the caps to direct light to a number of positions.

10 Claims, 4 Drawing Sheets

FLUORESCENT LAMP FIXTURE

BACKGROUND OF THE INVENTION

The present invention relates to a fluorescent lamp fixture and more particularly to a fixture which can be easily attached to a mounting surface and rapidly assembled without hand tools by merely pushing the components together.

Light fixtures of the fluorescent-type having components which can be snapped together are not new. U.S. Pat. No. 2,559,639 is typical of the prior art and has a housing formed of oppositely disposed members that have sidewalls which are shaped to enable them to be snapped together. However, the open ends of the housing are typically closed by means of plates secured to the housing by small screws and the like. Manual alignment of the screws and their securement is time consuming and can be troublesome if they need to be attached after the fixture is secured to a ceiling or other relatively inaccessible location. In addition, the means for securing the lens to the fixture must be relatively simple to enable removal for easy replacement of the lamp yet be effective to insure against inadvertent detachment.

In contrast, applicant's lamp fixture comprises channel and cover members each having complimentary bead means to enable the members to be snapped together. The cover member carries holders for receiving the lamp and other electrical components. A pair of plug-in end caps are provided, each having oppositely disposed flanges integrally formed therewith, the sides of one of the flanges each containing guide means in the form of a recess for receiving the bead means and a projection which engages a corresponding notch formed in the cover member to insure proper alignment. Each end cap also has a pair of legs which engage the channel member and provide a spacing means. A lens is provided having a pair of ribs which snap into detachable engagement with an operature in the end cap flanges to hold the lens adjacent the end caps.

In another embodiment, a light shield can be substituted for the diffuser lens to enable light to be directed. The shield is rotatably mounted on a pair of adaptors, each of which are positioned adjacent the end caps and on the cover member.

It is therefore the primary object of my invention to provide a superior lamp fixture of the fluorescent type.

It is another object of my invention to provide a lamp fixture, the major components of which can be rapidly assembled in the field.

It is a further object of my invention to provide a lamp fixture having end caps which can be rapidly aligned in the open end of its housing and perform the dual function of providing a means for detachably securing the lens thereto as well as a spacing between the housing and a mounting surface.

It is a still further object of my invention to provide a lamp fixture which has a diffuser-type lens that can be removed and an adjustable light shield substituted therefor to enable light to be directed to a specific location.

It is yet another object of my invention to provide a lamp fixture of the subject type which is simple in construction and relatively inexpensive to make yet can be rapidly assembled with little manual dexterity into a sturdy assembly.

With these and other objects, variations, modifications and adaptations which can be readily improvised by one skilled in the art, it is my intention not to be limited by the illustrations of the preferred example of my invention as described fully hereinbelow, but to be limited solely by the basic concepts underlying the fundamental principles as defined in the hereunto appended claims.

DETAILED DESCRIPTION

Figure 1:
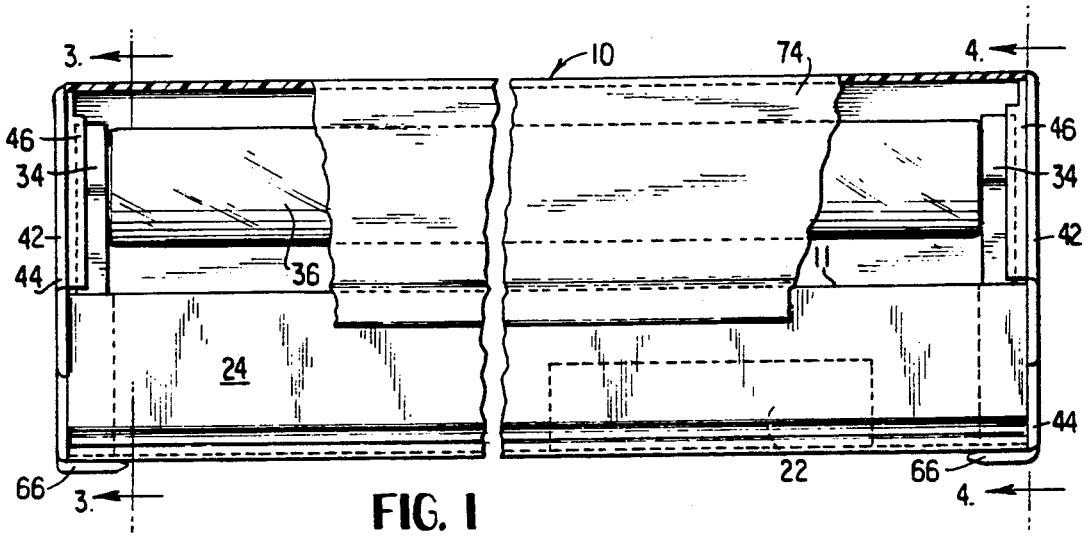
FIG. 1 is a side elevational view with areas partially broken away.
Figure 2:
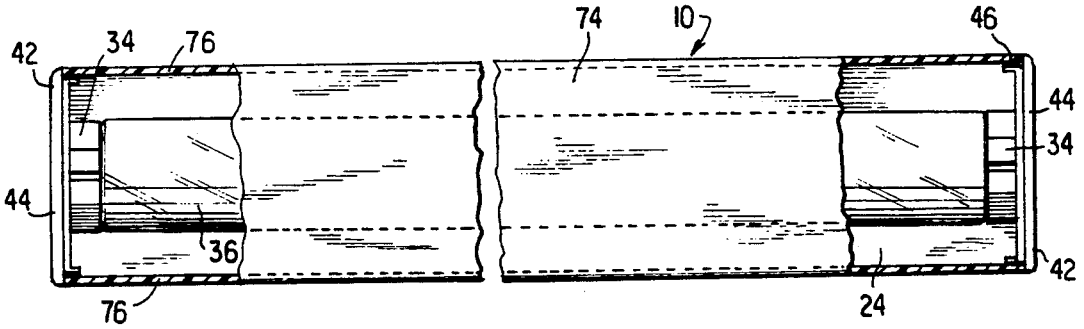
FIG. 2 is a plan view of the light fixture of the subject invention with areas partly broken away.

Referring now to the drawings where like reference numerals indicate like elements in each of the several views, numeral 10 of FIG. 1 and 2 represents the fluorescent-type lamp fixture of the present invention. The lamp fixture 10 with a tubular-shaped housing 11 has a one piece U-shaped channel member 12 usually made out of stamped or extruded sheet-type metal having a base portion 14 and upstanding sidewalls 16. The sidewalls 16 each have an inwardly facing beaded portion 18 running the length thereof adjacent the free edges and have a corresponding depressed portion 20 facing outwardly. The base portion 14 serves as a mounting platform for various electrical components of the fixture such as ballast 22 or the like.

Figure 3:
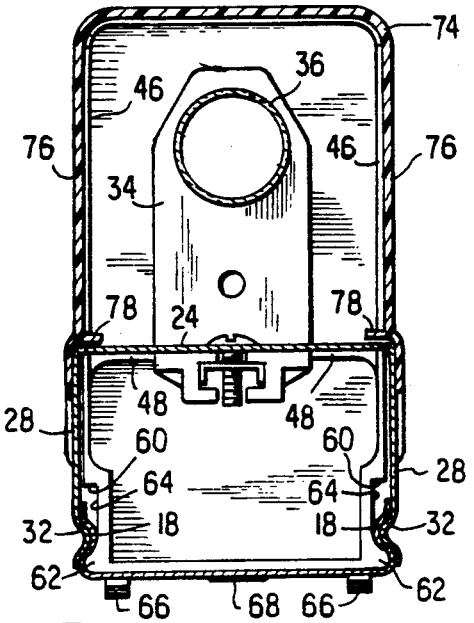
FIG. 3 is a cross-sectional view taken along the lines 3—3 of FIG. 2.
Figure 4:
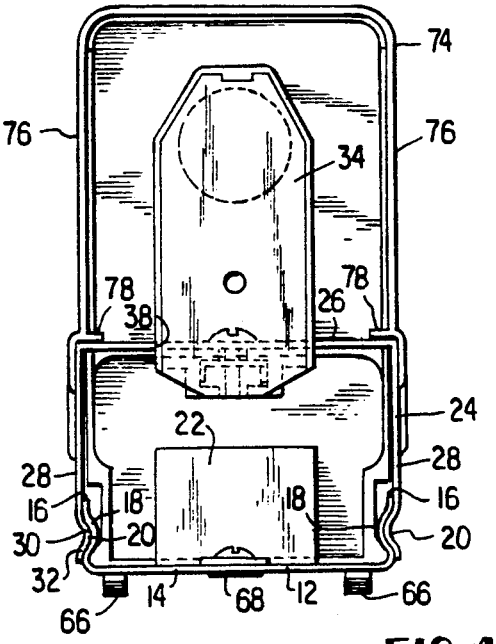
FIG. 4 is a cross-sectional view taken along the lines 4—4 of FIG. 2.

A one piece U-shaped cover member 24 is also provided similarly formed of the same material as the channel member 12. The cover member 24 has a top portion 26 and longitudinally extending sidewalls 28 with similar inwardly facing depressed portions 32 adjacent the free edges thereof. During assembly of the U-shaped channel and cover members 12, 24, the inwardly facing beaded portions 30 of the cover member 24 can be slid over or more rapidly snapped into the depressed portion 20 of the channel member 12 to thereby form the tubular-shaped housing 11 as can best be seen by referring to FIGS. 3 and 4. The cover member 24 carries a pair of spaced-apart holders 34 for receiving the ends of a fluorescent lamp 36. The holders 34 are mounted in cutouts 38 formed in the top portion 26 and contain contacts (not shown) for electrical connection to the contacts on the ends of the lamp 36 in a well known manner. The top portion 26 also has a pair of spaced-apart rectangular-shaped notches 40 which extend inwardly from the edges of the top portion 26 parallel to the sidewalls 28 as can best be seen by referring to FIG. 5.

Figure 6:
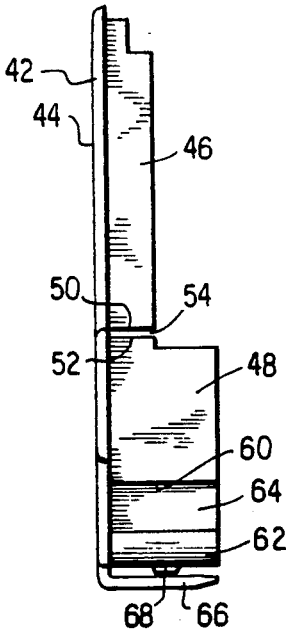
FIG. 6 is an rear elevational view of the end cap of the subject fixture.
Figure 7:
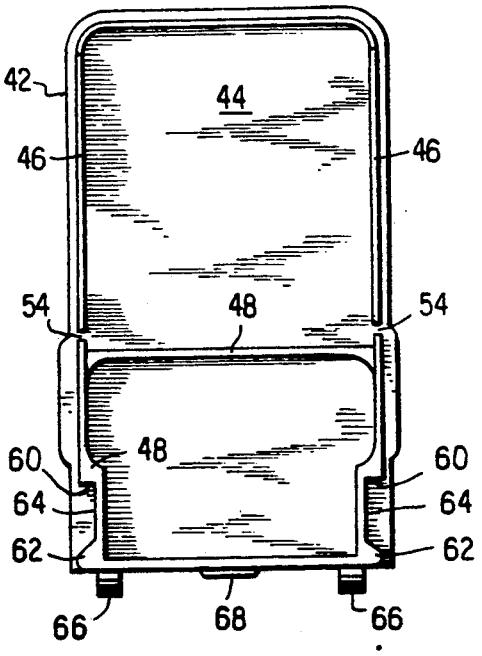
FIG. 7 is a side elevational view of the end cap of the subject fixture.

A pair of end caps 42 molded of plastic-type material are provided, as shown in FIGS. 6 and 7, each having an end wall member 44, which when installed, encloses the ends of the assembled channel and cover members 12, 24. The end wall 44 of the end caps 42 each have an upper rim or flange element 46 integrally formed therewith and a lower rim or flange element 48, both flange elements being substantially U-shaped. The ends 50, 52 of the respective upper and lower flanges 46, 48 are spaced-apart and define a slot 54 the function of which will be more fully described later. The ends 52 of the lower flange 48 have a portion 56 directly adjacent thereto having the same substantial thickness as the thickness of the sheet metal material forming the cover member 24. When the lower flange element 48 is inserted into the open end 58 of the tubular housing 11, the portions 56 act as a guide as they enter the notches 40 with cover member 24 and also serve to stabilize the end caps 42 against pivotal movement therein. The ends 52 are substantially flush with the outside surface of the top portion 26 when the lower flange 48 fully enters the open end 58.

In addition, the end caps 42 each have a pair of recesses 60 formed in opposite sides of the lower flange 48 and extend the width thereof. The flange 48 also has a pair of lips 62 adjacent the recesses 60 which act as a guide for the end caps 42 when inserted beneath the beaded portions 18 of the channel member 12. The wall 64 of the recesses 60 engage the beaded portions 18 to provide a somewhat snug fit as do the lips 62 when in position to thereby further stabilize the end caps 42 adjacent the open ends 58. The end wall members 44 of the end caps 42 have a pair of feet 66, one end of which is formed integrally therewith. The feet 66 are spaced from, and extend substantially the width of the lower flange 48 as can best be seen in FIG. 6. The feet 66 serve as a spacing element between the base portion 14 and the surface (not shown) on which the lamp fixture 10 is to be mounted. The end caps 42 are secured adjacent the open ends 58 by means of tapered catch members 68 shown in FIGS. 6 and 7 integrally formed on the bottom surface of the lower flange 48 which engage an aperture 70 in the base portion 14 of channel member 12 to thereby prevent the flange from being withdrawn. An electrical outlet receptacle 72 can be provided in one or both of the end caps 42 if desired.

A lens 74 extends the length of the fixture 10 between the end caps 42. The configuration of the lens 74 is U-shaped and substantially the same as the configuration of the upper flange 46. The depending sidewalls 76 of the lens 74 have integrally formed, longitudinally extending projections 78. During installation or removal of the lens 74 from the fixture, the depending sidewalls 76 are slightly flexed away from each other so that the projections can ride adjacent the upper flange 46 as the lens is pushed toward the tubular housing 11. The projections 78 then snap into slots 54 to thereby maintain the lens 74 adjacent the upper flanges 46 between the end walls 44 of the end caps 42. The projections 78 extend the entire length of the lens 74 to help support the lens on the cover member 24 and also prevent crushing of the lens.

Figure 9:
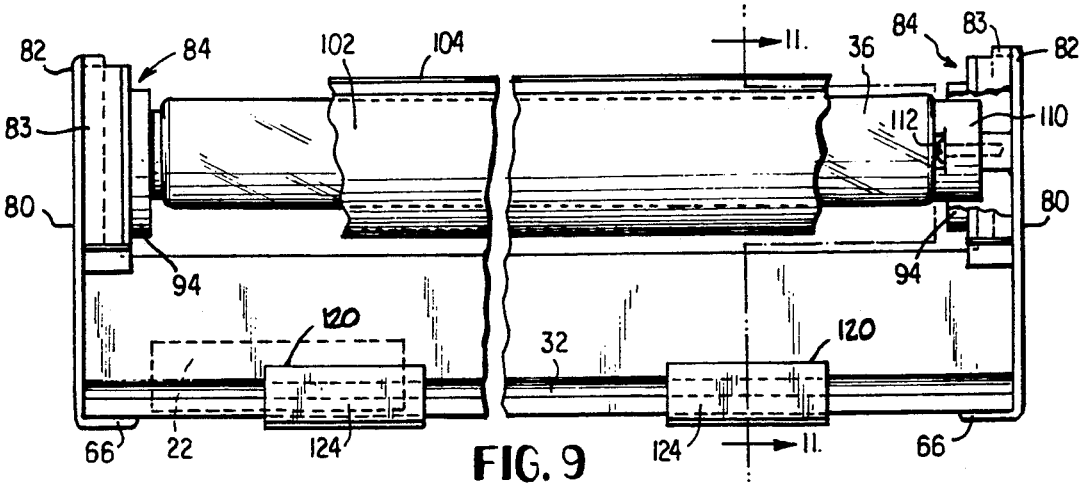
FIG. 9 is a side elevational view of another embodiment of the invention having a rotatable light shield with areas broken away.
Figure 10:
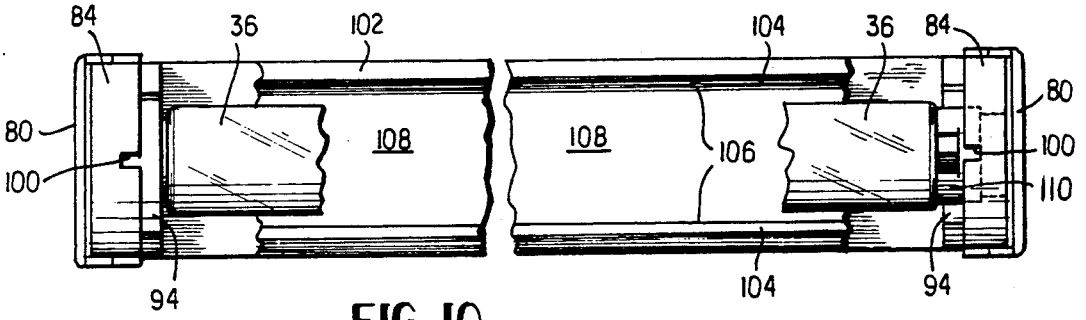
FIG. 10 is a plan view of the embodiment of FIG. 9 with areas broken away.
Figure 11:
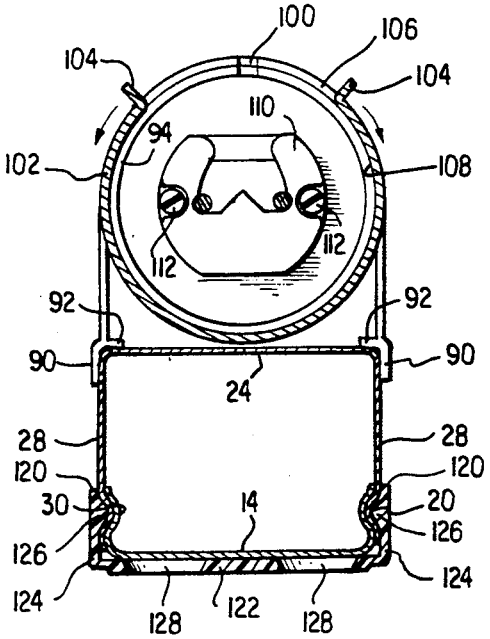
FIG. 11 is a cross-sectional view taken along the lines 11—11 of FIG. 9.
Figure 8:
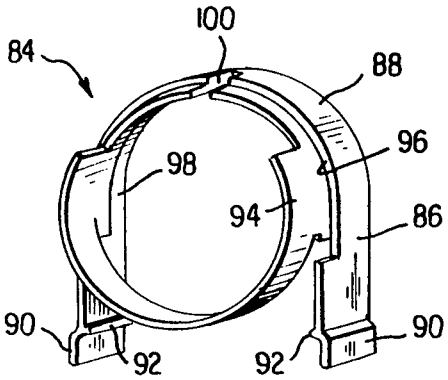
FIG. 8 is a perspective view of the adaptor used with the embodiment of FIGS. 8 and 9.

In a second embodiment set forth in FIGS. 8–12 there is disclosed a shield for the fluorescent light to provide a directionable lighting capability. The end caps 80 in this embodiment are formed with a curved upper area 82 and curved upper flange element 83 but in all other respects are the same as end caps 42. An adaptor 84, which can best be seen in FIG. 8, is provided moulded out of substantially the same plastic-type material as the end caps 80. The adaptor 84 has a rearward portion 86 having an upper area 88 of the same curvature as upper area 82 of end cap 80 and terminating on either side in an extension 90 having a projection 92. The adaptor 84 also has an integrally formed forward portion 94 of substantially cylindrical-shape off-set at 96 from the outer surface of the rearward portion 86 to thereby form an arcuate recess 98 beneath the upper area 88. The adaptor 84 is positioned on the cover member 24 so that the projections 92 rest on the top 26 and extensions 90 are positioned adjacent side walls 28 as seen in FIGS. 9 and 10. The adapter 84 is then pushed toward the end cap 80 to its final position wherein the curved upper flange element 83 is located in arcuate recess 98. The projections 92 also enter slots 54 which hold the adaptor 84 in position adjacent the end caps 80. A slot 100 is provided at the top of the curved upper area 88 to permit the electrical contacts of the fluorescent lamp 36 to pass there-through during installation or removal.

An elongated shield 102 is also provided of substantially tubular shape which is rotatably mounted on the forward portion 94 of the adaptors 84 and held in position by means of friction between the contacting surfaces. The shield 102 has a pair of spaced-apart longitudinally extending lips 104 that define an open area 106 through which light from the lamp 36 can pass. The end caps 80 have small holders 110 secured thereto which also contain contacts (not shown) for electrical connection to the contacts on the end of the lamp in a well known manner. The holders 110 are secured to the end caps 80 by screws 112 or other means and are shaped to permit the shield 102 to be free to rotate between the holder 110 and the cover member 24. As can be seen, rotation of the shield 102 about the adaptors 84 causes the light from the lamp 36 to be directed to a desired location. The shield 102 can be provided with a highly reflective inner surface 108 of silver or the like to enhance light output through open area 106.

Figure 5:
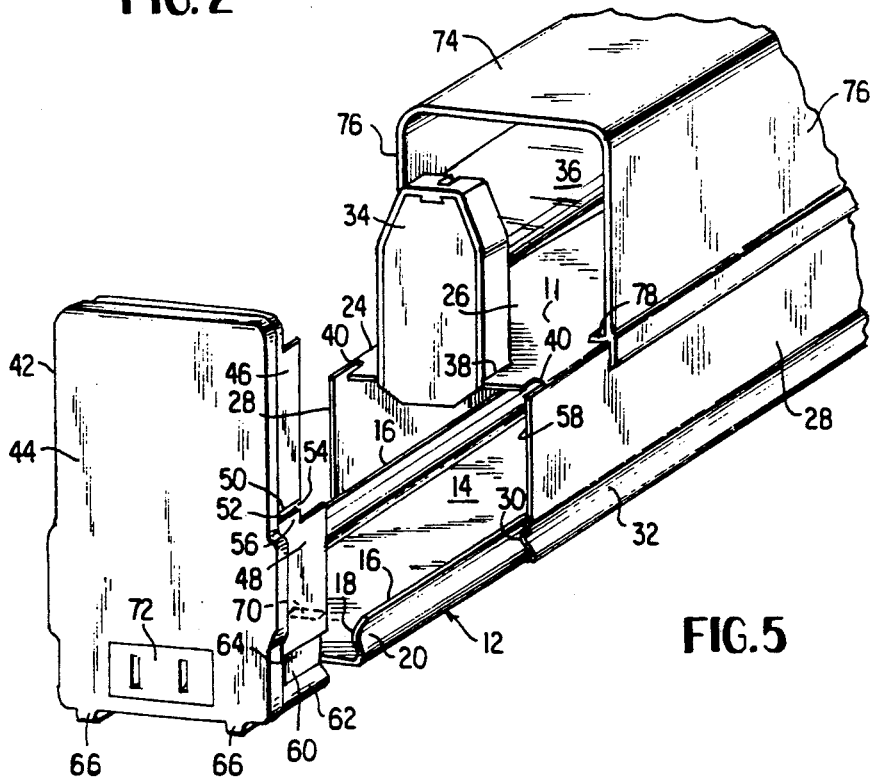
FIG. 5 is a partial perspective view of one end of the subject fixture.
Figure 13:
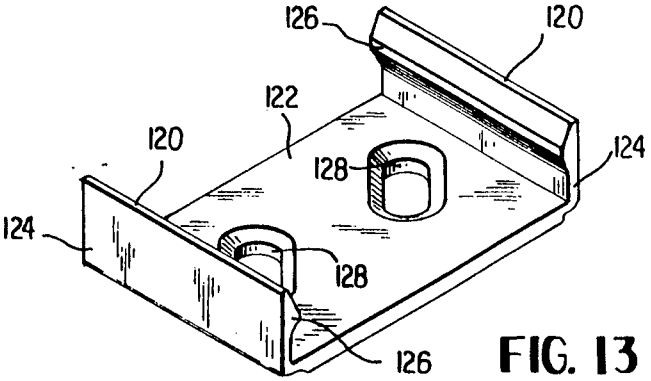
FIG. 13 is a perspective view of the adjustable bracket for mounting the light fixture on a ceiling or wall.
Figure 12:
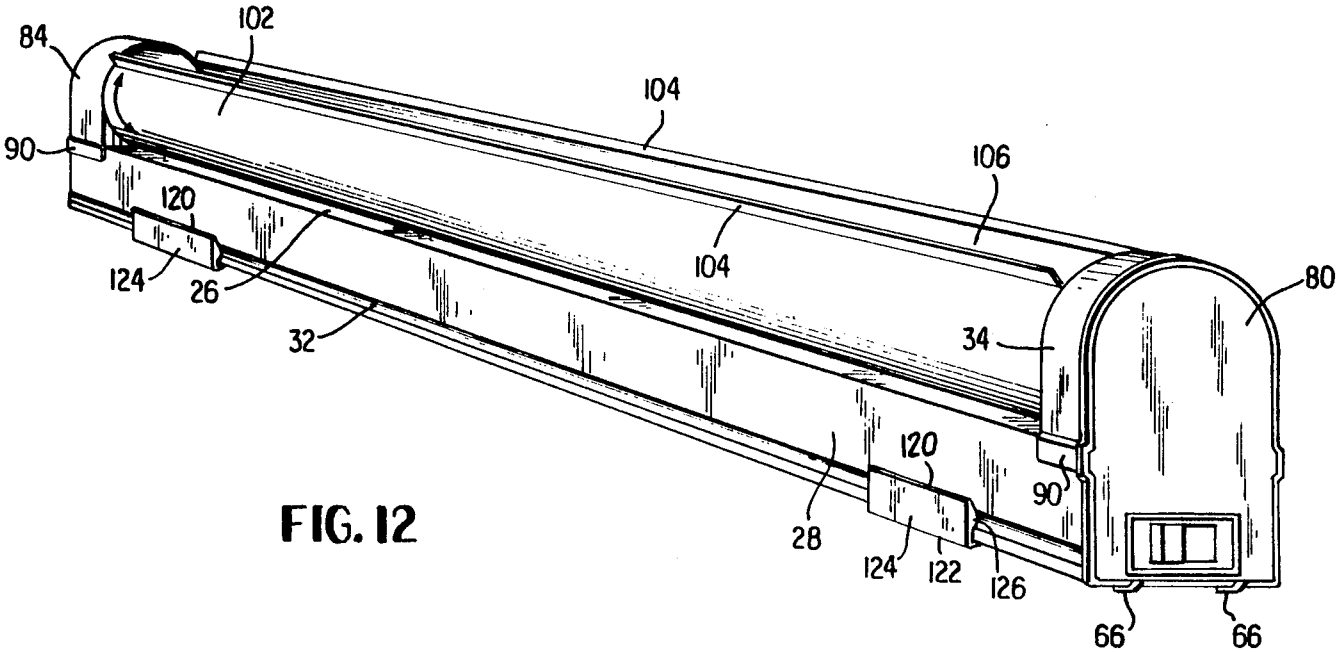
FIG. 12 is a perspective view of the subject fixture assembled utilizing the rotatable light shield.

A bracket 120 is provided for mounting the lamp fixture 10 by way of its cover member 24 to a surface such as a ceiling or wall. The bracket 120 is substantially U-shaped, as can be best seen in FIG. 13, and has a base portion 122 with a pair of spaced-apart longitudinally extending arms 124 integrally formed therewith. The arms 124 each have an inwardly projecting, oppositely disposed bead 126 running the length thereof which would be snapped into the depressed portions 32 on the cover member 24, as shown in FIG. 5, to hold the fixture 10. Typically, two or more brackets 120 would be secured to the mounting surface by screws (not shown) extending through holes 128 in the base portion 122.

Applicant has thus described both embodiments his novel lamp fixture for fluorescent-type bulbs which can be rapidly assembled with the aid of various guide elements on the end caps and which has latching elements on both the end caps as well as the lens to maintain the parts in assembled relationship during handling and use.

Many changes and modifications in the above-described embodiment of the invention can of course, be carried out without departing from the scope thereof. Accordingly, that scope is intended to be limited only be the scope of the appended claims.

What is claimed is:

1. A self-contained fluorescent lamp fixture comprising:

(a) a one piece sheet metal U-shaped channel member having a base and longitudinally extending sidewalls for accepting electrical components, said sidewalls having inwardly facing beads with outwardly facing corresponding depressions formed along the longitudinally extending free edges of said sidewalls remotely spaced from said base, (b) a one piece sheet metal U-shaped cover member having a top portion and longitudinally extending sidewalls, and a pair of spaced apart notches extending inwardly from each free end of said top and parallel to said sidewalls, said sidewalls having longitudinally extending inwardly facing beads which are snapped into engagement with said outwardly facing depressions after said sidewalls are flexed momentarily outward to thereby initially maintain said channel member and said cover together, (c) first and second plug-in end cap members each having a face plate and a first flange element extending perpendicularly outward of said face plate adjacent one end thereof, said first flange having a recess and a projection on each side thereof for engaging said inwardly facing beads on said channel member and said notches, respectively, when inserted into said assembled channel and cover member, (d) holder means for receiving a fluorescent lamp, and (e) means adjacent said end caps and said cover member to control the light emanating from said fluorescent lamp.

2. The lamp fixture as set forth in claim 1 wherein said end caps have a second flange element extending perpendicularly outward of said face plate adjacent the other end thereof, said first and second U-shaped flanges forming a first and second slot therebetween, and wherein said light control means has a first and second longitudinally extending rib formed on the inside surface thereof which engage said first and second slots, respectively, to maintain said lens adjacent said end caps.

3. The lamp fixture as set forth in claim 1 wherein each of said end caps has two spaced-apart legs spaced from said first flange element which engage said base of said channel member and provide spacing between said end caps and the surface to which said fixture is mounted.

4. The lamp fixture as set forth in claim 1 wherein said channel member has a recess at each end thereof and said first flange element has a projection thereon which engages said recess when said end caps are plugged in to thereby prevent said end caps from being removed.

5. The lamp fixture as set forth in claim 1 further comprising:

(a) first and second adaptor means located on said cover member in mating engagement with a respective one of said first and second plug-in end cap members; and (b) light shield means rotatably mounted on said first and second adaptor means and around said fluorescent lamp to direct light therefrom into a concentrated area.

6. The lamp fixture as set forth in claim 5 wherein said end caps have a second flange element extending perpendicularly outward of said face plate and each of said adaptor means has an arcuate recess formed therein for receiving said second flange element in mating engagement.

7. The lamp fixture as set forth in claim 6 wherein said first and second flanges form a first and second slot therebetween, and said first and second adaptor means each have projection means which engage said first and second slot to maintain each of said adaptor means adjacent said cover member.

8. The lamp fixture as set forth in claim 5 wherein said light shield means frictionally engages said first and second adaptor means to thereby maintain said shield means in its desired position.

9. The lamp fixture as set forth in claim 1 further comprising bracket means for mounting said lamp fixture on a surface, said bracket means having oppositely disposed, spaced-apart arms adapted to engage said cover member in a depression formed by said longitudinally extending inwardly facing beads on said sidewalls of said cover member.

10. A self-contained fluorescent lamp fixture comprising:

(a) a channel-like housing member having open opposite ends for accepting electrical components;

(b) first and second end cap members, each having plug-in means for insertion into one of said open opposite ends of said housing, each of said cap members having a holder means mounted on one side thereof for receiving one end of a fluorescent lamp;

(c) first and second adaptor means positioned on said housing and slidable into mating engagement with a respective one of said first and second end cap members; and (d) light shield means rotatably mounted on said first and second adaptor means and around said fluorescent lamp positioned between said holders to direct light therefrom into a concentrated area.

* * * * *